United States Patent [19]

Takenoya

[11] 4,254,726

[45] Mar. 10, 1981

[54] SEWING MACHINE CONTROL MECHANISM

[75] Inventor: Hideaki Takenoya, Hachi-ji, Japan

[73] Assignee: Janome Sewing Machine Co. Ltd., Tokyo, Japan

[21] Appl. No.: 121,255

[22] Filed: Feb. 13, 1980

[30] Foreign Application Priority Data

Feb. 24, 1979 [JP] Japan ..... 54-23573[U]

[51] Int. Cl.[3] ..... D05B 3/02; D05B 27/22

[52] U.S. Cl. ..... 112/315; 112/221

[58] Field of Search ..... 112/315, 314, 313, 158 R, 112/158 A, 158 D, 220, 221

[56] References Cited

U.S. PATENT DOCUMENTS

| | | | |
|---|---|---|---|
| 3,064,604 | 11/1962 | Moro | 112/315 |
| 3,198,154 | 8/1965 | Reeber | 112/315 |
| 3,753,411 | 8/1973 | Graham et al. | 112/315 |

*Primary Examiner*—H. Hampton Hunter

*Attorney, Agent, or Firm*—Michael J. Striker

[57] ABSTRACT

The stitch-forming instrumentalities of a sewing machine are subject to small mechanical operational errors due to play in the motion-transmitting connections. The invention overcomes this problem by providing two springs which are respectively connected to a transmission element coupled to a driven mechanism of the machine, and to a drive. The two springs counterbalance one another with respect to the drive.

4 Claims, 3 Drawing Figures

SEWING MACHINE CONTROL MECHANISM

BRIEF DESCRIPTION OF THE INVENTION

The invention relates to a control mechanism, particularly for a sewing machine to exactly operate the stitch forming instrumentalities of the sewing machine by precluding minor mechanical operation errors thereof, thereby to produce correct stitches.

For attaining this object, one spring of a predetermined moment is employed to bias a drive transmission element toward a drive source, and another spring is employed to bias the drive source toward the drive transmission element. The latter spring is of a moment equal to that of the former spring to counter-balance the same with respect to the drive source.

In the conventional sewing machines, there are errors more or less in the movement transmission, due to clearances at the mechanical connections, from a drive source, for example, a control motor to the needle bar mechanism or to the fabric feeding mechanism. These mechanical clearances are generally compensated by a spring applied to the transmission elements. Such a spring, however, results in encouraging the drive of the drive source to the needle bar mechanism (or the feeding mechanism) in one direction, and in lowering the drive of the drive source to the driven mechanism in the opposite direction, and vice versa. Such an unbalance of drive adversely influences the control of the driven mechanism, and necessitates the employment of a big sized drive source of a strong power.

The present invention has been provide to eliminate the defects and disadvantages of the conventional sewing machines.

It is a primary object of the invention to effectively provide first and second springs, one applied to a transmission element connected to a drive mechanism, and the other applied to a drive source, said first and second springs counterbalancing each other with respect to the drive source.

It is another object of the invention to provide a sewing machine control mechanism of simple structure and of effective operation.

The other features and advantages of the invention will be apparent from the following description of the preferred embodiments in reference to the attached drawing.

DETAILED DESCRIPTION OF THE INVENTION

Figure 1:
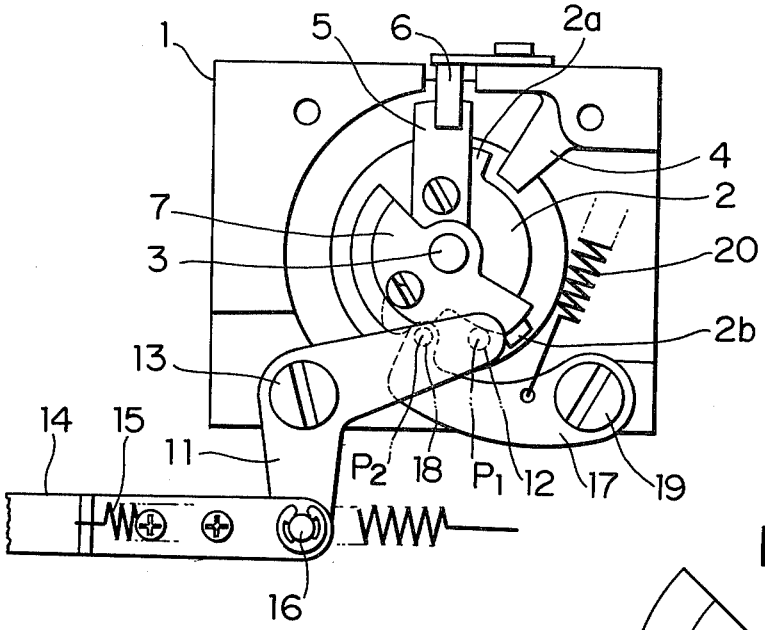
FIG. 1 is a front elevational view of a sewing machine control mechanism of the invention.
Figure 2:
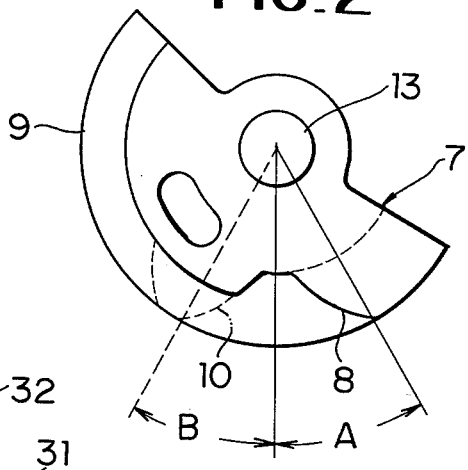
FIG. 2 is a detailed view of a cam of the control mechanism.

In reference to FIG. 1 the reference numeral 1 is a support body secured to the housing of a sewing machine (not shown). A stopper plate 2 is secured to a shaft 3 of a pulse motor which is to control the lateral needle swinging movement. As shown, the stopper plate 2 has two spaced projections *2a, 2b* for limiting the rotation range of the pulse motor shaft 3 in cooperation with a stopper 4 secured to the support body 1. The refence numeral 5 is a photo-interrupting plate secured to the stopper plate 2 for rotation therewith in order to interrupt a light from a light emitting part 6 provided on the support body 1 as shown, thereby to produce the rotational position indicating signals of the pulse motor. A double cam 7 is secured to the stopper plate 2 for rotation therewith. As shown in FIG. 2, the double cam 7 is, on the front side thereof, formed with a control cam face 8 of a control range A for controlling the lateral needle swinging movement. The double cam 7 is also, on the rear side thereof beyond a peripheral flange 9, formed with a balancing range B. The control cam face 8 is engaged by a follower pin 12 which is secured to one end of a transmisstion lever 11 as shown in FIG. 1. The transmission lever 11 is, at the intermediate part thereof, turnably mounted on the support body 1 by means of a stepped screw 13. The other end of the transmission lever 11 is connected to one end of a transmission rod 14 by means of a pin 16. The transmission rod 14 has the other end operatively connected to the needle bar (not shown). As shown, a first tension spring 15 is, at one end thereof, connected to the transmission rod 14, and is, at the other end thereof, anchored to the support body 1, so as to normally bias the transmission rod in the rightward direction, thereby to press the follower pin 12 against the cam face 8. At the same time, the tension spring 15 presses the level 11 against a part of the pivot 13, and also the connecting pin 16 against a part at the end of the lever 11. The pressure of the pin 12 against the cam face 8 pushes the double cam 7 in the counter-clockwise direction due to the component force of the cam face 8. The cam face 10 is engaged by a follower pin 18 which is secured to the free end of a balancing lever 17 which is turnably mounted on the support body 1 by means of a stepped screw 19. A tension spring 20, is at one end thereof, connected to the balancing lever 17, and is, at the other end thereof, connected to the support body 1, thereby to press the follower pin 18 against the balancing cam face 10. The pressure of the follower pin 18 against the cam face 10 pushes the double cam 7 in the clockwise direction due to the component force of the cam face 10. Provided that there is not frictional force at the points $P_1$, $P_2$ of the cam faces 8, 10 engaged by the follower pins 12, 18 respectively, the balancing condition, that the compound moment due to the engaging pressures at the points $P_1$, $P_2$ becomes zero with respect to the pulse motor shaft 3, is that the moment of the point $P_1$ and the moment of $P_2$ each around the motor shaft 3 are of the same amount in the opposite rotational directions. In other words, the moment produced at the point $P_1$ around the center pivot 13 by the lever 11 due to the tension spring 15 is a moment produced by the tangential component force of the pressure normal to the cam face point $P_1$ around the central axis 3. Similarly, the moment produced at the point $P_2$ around the center pivot 19 by the lever 17 due to the tension spring 20 is a moment produced by the tangential component force of the pressure normal to the cam face point $P_2$ around the central axis 3. Since the two moments are equal and directed in the opposite rotational directions, it is possible to determine the tensional force of the springs 15, 20, the distances between the pivot positions 13, 19 of the levers 11, 17 and the engaging points $P_1$, $P_2$ of the double cam 7, and the configuration of the double cam 7, so that such a condition of the two moments may be applied to all the rotational phases of the double cam 7. Since there is actually a frictional force at the cam points $P_1$, $P_2$ in the tangential directions of the cam faces 8, 10, this is taken into account to seek for the configuration of the cam 7 by a graphical calculation. According to the invention, the cam faces 8, 10 are made symmetrical so as to approximately meet the various requirements.

Figure 3:
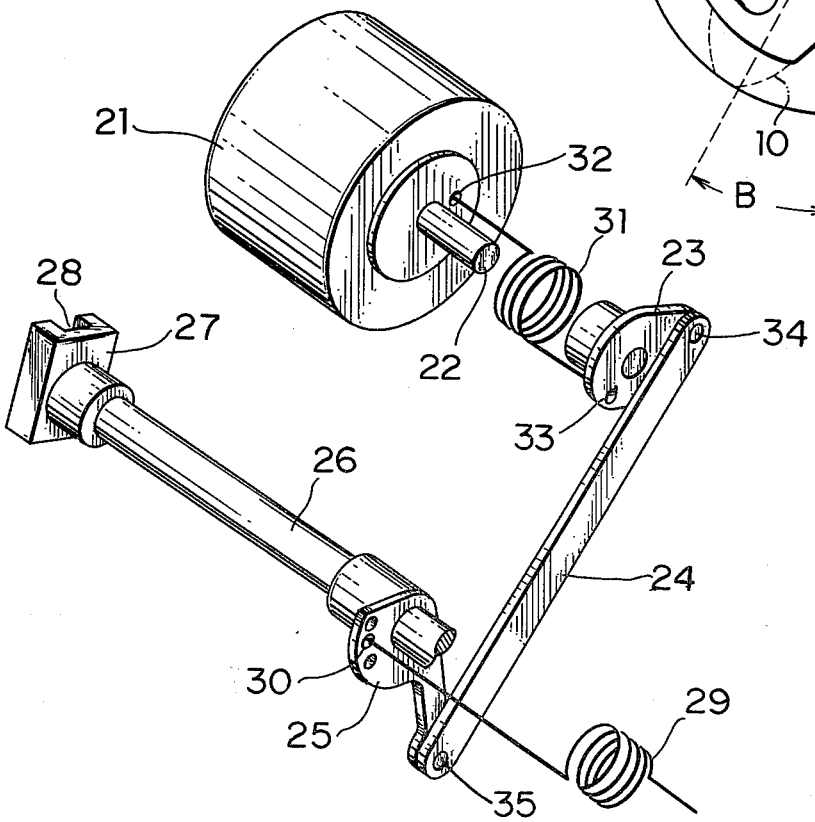
FIG. 3 is a perspect view of another embodiment of the invention.

FIG. 3 shows another embodiment of the invention, in which a pulse motor 21 has a shaft 22 fixedly connected to a link 23 which is connected to one end of a transmission rod 24 by means of a pin 34. The transmission rod 24 has the other end connected to another link 25 by means of a pin 35 as shown. The link 25 is secured to a fabric feed adjusting shaft 26 of a sewing machine. A fabric feed adjuster 27 with a vertical groove 28 as well known is secured to the free end of the feed adjusting shaft 26. As well known, the feed adjuster 27 is angularly adjusted to vary the horizontal movement of a feed dog, thereby to control the feeding amount of a fabric to be sewn. A coil spring 29 is, at one end thereof connected to one of the holes 30 of the link 25, and is, at the other end thereof, anchored to a machine housing (not shown), thereby to bias the feed adjusting shaft 26 in the clockwise direction and therefore to bias the motor shaft 22 in the clockwise direction. A coil spring 31 is, at one end thereof, connected to a hole 32 of a disk secured to the pulse motor shaft 22, and is, at the other end thereof, anchored to the machine housing, thereby to bias the motor shaft 22 in the counterclockwise direction. The coil springs 29, 31 are so set as to give a zero compound rotational force of the motor shaft 22 by way of the transmission rod 24. Namely the moments of the springs 29, 31 are of the same amount in the opposite direction.

I claim:

1. A sewing machine with stitch forming instrumentalities changing the relative positions of a needle and a fabric to be sewn to produce stitches in the fabric, comprising drive means (21) operatively connected at least one of the stitch forming instrumentalities, transmission means (11, 24) having one end directly connected to the drive means and the other end operatively connected to the one of the stitch forming instrumentalities, first spring means (15, 29) applied to the other end of the transmission means to bias the latter in the direction to the drive means, and second spring means (20, 31) applied to the drive means to bias the latter in the direction to the other end of the transmission means, said first and second spring means being set to provide a compound moment of zero with respect to the drive means.

2. A sewing machine as defined in claim 1, further comprising cam means (7) having two separate cam faces (8, 10), and lever means (17) having one end turnably mounted on a support means (1), and the other end provided with a follower (18) engaged against one of the cam faces by means of the second spring means (20) applied to the lever means, and wherein said drive means (21) is a pulse motor having a drive shaft (3) fixedly connected to the cam means, and said transmission means (11) is a lever which is at the intermediate part thereof turnably mounted on the support means (1), said lever having the one end provided with a follower (12) engaged against the other of the cam faces by means of the first spring means (15).

3. A sewing machine as defined in claim 1, wherein said first and second spring means are tension springs.

4. A sewing machine as defined in claim 1, wherein said first and second spring means are torsion springs.

* * * * *